US007825793B1

(12) United States Patent
Spillman et al.

(10) Patent No.: US 7,825,793 B1
(45) Date of Patent: Nov. 2, 2010

(54) REMOTE MONITORING AND CONTROL SYSTEM

(75) Inventors: Vance P. Spillman, Bristol, RI (US); Craig H. Rosenquist, Scituate, MA (US); James G. Hall, Plymouth, MA (US); Daniel C. Walker, Hanover, MA (US)

(73) Assignee: Sunrise Technologies, Inc., Rayham, MA (US)

( * ) Notice: Subject to any disclaimer, the term of this patent is extended or adjusted under 35 U.S.C. 154(b) by 841 days.

(21) Appl. No.: 11/748,382

(22) Filed: May 14, 2007

Related U.S. Application Data

(60) Provisional application No. 60/815,551, filed on Jun. 21, 2006.

(51) Int. Cl.
*G08B 1/08* (2006.01)

(52) U.S. Cl. ..... 340/539.1; 340/539.17; 340/539.18; 340/539.22; 340/545.3; 340/507; 340/508; 455/404.1; 455/557

(58) Field of Classification Search ..... 340/539.1, 340/539.17, 539.18, 539.22, 545.3, 507, 340/508; 455/404.1, 557
See application file for complete search history.

(56) References Cited

U.S. PATENT DOCUMENTS

| | | | | |
|---|---|---|---|---|
| 4,998,095 | A * | 3/1991 | Shields | 340/574 |
| 5,416,468 | A * | 5/1995 | Baumann | 340/573.1 |
| 6,888,459 | B2 | 5/2005 | Stilp | |
| 7,019,639 | B2 | 3/2006 | Stilp | |
| 7,042,353 | B2 | 5/2006 | Stilp | |
| 7,084,756 | B2 | 8/2006 | Stilp | |
| 2004/0125782 | A1 | 7/2004 | Chang | |
| 2004/0127254 | A1 | 7/2004 | Chang | |
| 2004/0212494 | A1 | 10/2004 | Stilp | |
| 2004/0212497 | A1 | 10/2004 | Stilp | |
| 2004/0212503 | A1 | 10/2004 | Stilp | |
| 2004/0215750 | A1 | 10/2004 | Stilp | |
| 2005/0027787 | A1 | 2/2005 | Kuhn et al. | |
| 2005/0286466 | A1 | 12/2005 | Tagg et al. | |
| 2006/0031180 | A1 | 2/2006 | Tamarkin et al. | |
| 2006/0046664 | A1 | 3/2006 | Paradiso et al. | |
| 2006/0071775 | A1 | 4/2006 | Otto et al. | |
| 2006/0079280 | A1 | 4/2006 | LaPerch | |
| 2006/0132284 | A1 | 6/2006 | Murphy et al. | |
| 2006/0132301 | A1 | 6/2006 | Stilp | |
| 2006/0132302 | A1 | 6/2006 | Stilp | |
| 2006/0132303 | A1 | 6/2006 | Stilp | |
| 2006/0135206 | A1 | 6/2006 | Louks et al. | |
| 2006/0145842 | A1 | 7/2006 | Stilp | |
| 2006/0160569 | A1 | 7/2006 | Chen et al. | |

* cited by examiner

*Primary Examiner*—Tai T Nguyen
(74) *Attorney, Agent, or Firm*—Strategic Patents, P.C.

(57) ABSTRACT

A communication system that provides communication of information between an end user device and a remote end user. The system includes a communication node mounted on the upper part of a utility pole, and drawing its power from the utility pole through a standard NEMA Locking 3 Pole Receptacle, and adapted to communicate with a nearby user device using the low-power communication protocol, such as the ZigBee protocol (ANSI IEEE 802.15.4) or Radio Frequency Identification Device (RFID) technology, and also adapted to communicate with a neighborhood mesh network of nodes mounted on utility poles. The neighborhood mesh network is capable of communicating, through a regional computer network, with the remote end user.

81 Claims, 5 Drawing Sheets

10
45
49
53
72
Internet Connection
Server
End User
Internet Connection
34
42
70
71
DC
DC
BN
BN
BN
19
EUD
13
DC
73
Internet Connection 10
45
Internet Connection
49
Server
53
End User
34
42
DC
70
71
DC
Internet Connection
BN
BN
19
EUD
13
DC

REMOTE MONITORING AND CONTROL SYSTEM

CROSS-REFERENCE TO RELATED APPLICATIONS

This application claims the benefit under 35 U.S.C. §119 (e) of U.S. Provisional Application No. 60/815,551 filed Jun. 21, 2006, which is hereby incorporated by reference.

STATEMENT REGARDING FEDERALLY SPONSORED RESEARCH OR DEVELOPMENT

This invention has been created without the sponsorship or funding of any federally sponsored research or development program.

FIELD OF THE INVENTION

This invention is a system for remote monitoring and control of a target zone by an end user.

BACKGROUND OF THE INVENTION

This invention is a system for monitoring and controlling parameters, such as air conditioning, water heating, unauthorized intrusion, electric use, water use, or gas use within a target sites such as a building, by a remote end user, who might be an operator at a fuel delivery dispatch facility, or at an intrusion monitoring center, or in a municipal water headquarters. Many systems have been developed to provide data communication between target sites and the remote end user, from the simplest form of a visit by the end user or his representative to the target site, such as a meter reader, to sophisticated direct microwave communication links, and many variations in between. In many cases, however, the systems are labor-intensive and very expensive either in equipment cost, installation, maintenance, and/or operation. Furthermore, many systems can be highly unreliable and are subject to difficulties caused by weather, system aging, environmental factors such as vandalism and accidents, and intentional interference with operation by various parties.

Nevertheless, there are many situations in which it would be desirable to provide remote monitoring and control of stationary or mobile target zones, such as buildings, yards, and vehicles of various sorts. It is common, for example, for intrusion sensors or fire alarms within a building to be hardwired through telephone lines to a central monitoring station. When the sensors detect certain events, the sensors send a signal through the hardwired telephone lines to the central monitoring station. The station can then take appropriate action. There are, however, numerous problems with hardwired systems, including installation expenses and vulnerability to tampering.

The introduction of wireless communication links into remote monitoring and control systems, especially close to the target zone appears to offer a significant installation cost savings and tamper resistance. Wireless communication links, however, typically possess critical difficulties.

Typically, wireless communication links are relatively expensive and generally too expensive to be used in many typical remote monitoring and control systems. This expense factor goes up considerably as the distance between the elements of the wireless communication link rises and as bandwidth requirements rise. Furthermore, typically, wireless communication links have relatively high power requirements that are too great to be used in many typical remote monitoring and control systems. This power requirements factor goes up considerably as the distance between the elements of the wireless communication link rises in as bandwidth requirements rise. In many cases, the use of local domestic power is impractical because of installation issues and reliability issues. Typical power-hungry devices have power requirements that are impractical for battery power and even battery backup.

These and other difficulties experienced with the prior art devices and systems have been obviated in a novel manner by the present invention.

It is, therefore, an outstanding object of some embodiments of the present invention to provide a communication system for monitoring and controlling a target site by a remote end user that is simple, reliable, and highly economical to install.

Another object of some embodiments of this invention is to provide a communication system for monitoring and controlling a target site by a remote end user that is simple, reliable, and highly economical to operate.

A further object of some embodiments of the present invention is to provide a communication system for monitoring and controlling a target site by a remote end user that is simple, reliable, and highly economical to maintain.

A further object of some embodiments of the present invention is to provide a remote monitoring and control system that employs low-power wireless devices within the target zone, to communicate with the remote user.

A further object of some embodiments of the present invention is to provide a remote monitoring and control system that employs low-power wireless devices within the target zone to communicate with a node adjacent to target zone.

A further object of some embodiments of the present invention is to provide a remote monitoring and control system that employs a low-power wireless device within the target zone to communicate with a node adjacent the targets zone, said node being a node on a neighborhood mesh network.

A further object of some embodiments of the present invention is to provide a remote monitoring and control system that employs a neighborhood mesh network formed of a series of nodes adjacent numerous target zones to gather data from low-power wireless devices within the target zones and present them, through a data collector, to an Internet node.

It is a further object of some embodiments of the invention to provide a communication system for monitoring and controlling a target site by a remote end user that is capable of being manufactured of high quality and at a low cost, and which is capable of providing a long and useful life with a minimum of maintenance.

With these and other objects in view, as will be apparent to those skilled in the art, the invention resides in the combination of parts set forth in the specification and covered by the claims appended hereto, it being understood that changes in the precise embodiment of the invention herein disclosed may be made within the scope of what is claimed without departing from the spirit of the invention.

BRIEF SUMMARY OF THE INVENTION

This invention is a communication system that provides communication of information between an end user device and a remote end user. The system includes a communication node mounted on the upper part of a utility pole. The node draws its electric power from the utility pole through a standard NEMA Locking 3 Pole Receptacle, and is adapted to communicate with a nearby end user device using the low-power communication protocol, such as the ZigBee protocol (ANSI IEEE 802.15.4) or Radio Frequency Identification Device (RFID) technology. The end user device is located in a target zone such as building. The node is also adapted to communicate with a neighborhood mesh network of nodes mounted on utility poles. The neighborhood mesh network is capable of communicating, through a regional computer network, with the remote end user.

BRIEF DESCRIPTION OF THE DRAWINGS

The character of the invention, however, may best be understood by reference to one of its structural forms, as illustrated by the accompanying drawings, in which.

DETAILED DESCRIPTION OF THE INVENTION

Figure 1:
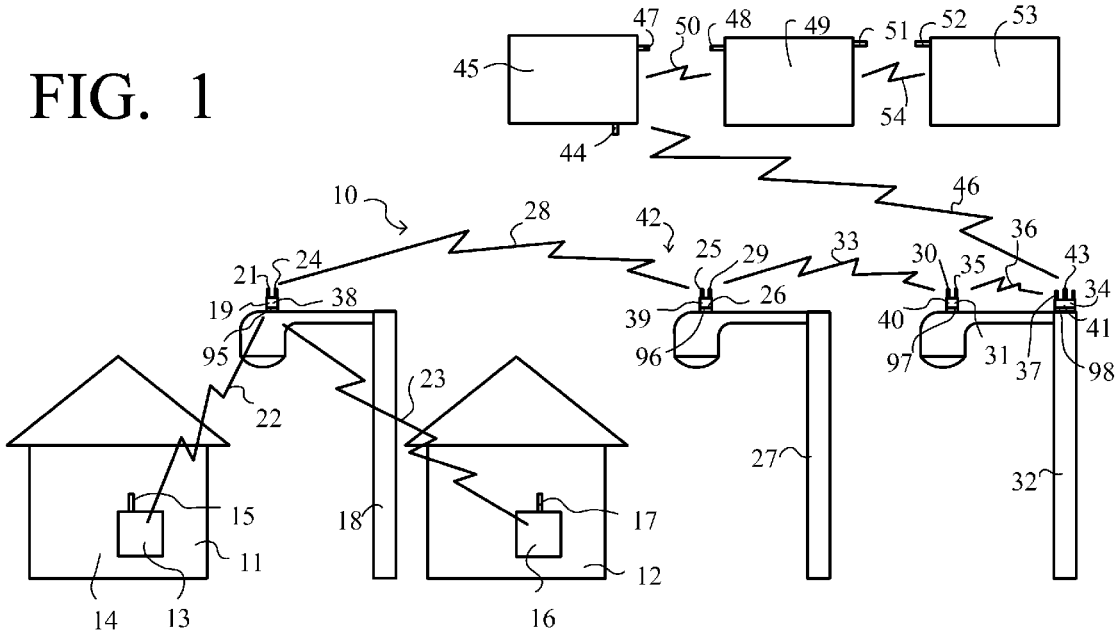
FIG. 1 is a schematic diagram of communication system for monitoring and controlling a target site by a remote end user embodying the principles of the present invention.

This invention is a combination and interconnection of two existing technologies; mesh networks, and low-power, low-cost transceivers. The invention allows a person (an "end user" such as a city electrical worker) to monitor and/or control certain events (such as municipal electrical use) that are occurring in a remote location (such as any particular house), with an end user device (such as a domestic electrical use meter and associated communications device).

One base technology is a mesh network, a network of communication nodes distributed around a geographical area and capable of communicating with one another. In some mesh networks, the network is capable of communicating downward to lower-level communication devices within the geographic area. These lower-level devices are capable of communicating with one or more nodes of the mesh network. The mesh network is also capable of communicating upward to a network that extends beyond the geographical area of the mesh network.

One popular type of mesh network is a Municipal wide-area communication network (MWAN), sometimes called a WiFi network. This technology allows computers throughout a community to communicate with the Internet by radio frequency communication between a computer and the nearest of a network of nodes located throughout the municipality. The nodes communicate with one another and ultimately are connected to the Internet. In order for a computer to participate in this wireless communication system, it must have a radio frequency communication device called a WiFi card or equivalent, which is relatively expensive, has relatively high power usage, and relatively long-range.

A second base technology involves short-range (10 to 100 meters), narrow bandwidth (20-250 KB/s), low-power-use (battery life 10-1000 days), radio receiver-transmitter systems now being produced at a very low cost. One such technology is popularly called "ZigBee" and operates under the IEEE 802.15.4 standard. A relevant current application for this kind of technology could involve measuring the electrical use at a particular house. The electric system within the house is supplied with an electric use metering system that measures electricity use. The metering system provides a signal concerning electrical use in the home to a "ZigBee" unit. The ZigBee unit produces a radio signal representative of the electrical use within the house (including an identifier or address of the particular ZigBee unit). The signal reaches out to the street in front of the house. The signal is converted and sent directly to the Internet via WiFi, telephone, cell phone, fiber, WiMax or other means. This system of monitoring activities within a building is much more efficient and less expensive than direct connection to the Internet.

A third base technology involves short-range (10 to 100 meters), narrow bandwidth (20-250 KB/s), low-power-use (battery life 10-1000 days), radio receiver-transmitter systems now being produced at a very low cost. A relevant current application for this kind of technology could involve measuring the electrical use at a particular house. The metering system provides a signal concerning electrical use in the home. The unit produces a radio signal representative of the electrical use within the house (including an identifier or address of the particular unit. The signal reaches out to the street in front of the house. In existing technology, a utility vehicle provided with an appropriate unit can pick up the signal as the vehicle passes by the house and thereby measures the electrical use of the house for appropriate billing. This system of monitoring the activities within a building is much more efficient than sending around traditional human meter readers that must enter each individual dwelling or contact outside transponders with a reading device.

Another version of the second base technology involves radio frequency identification devices (RFID). These devices are very low power or no power (back-scatter) radio transceivers that are capable of communicating with an RFID reader. Typically, the reader scans the device with a radio frequency field, the device uses its own power or the power from the scan to modulate and retransmit a signal to the reader. Typically the device uses backscatter modulation technology. Normally, the device would simply transmit its address or identity, located in internal memory, However, it could also be connected to a sensor that produces data and the unit could transmit that data.

The important embodiment of the present invention is to provide a "conversion box" on each utility light pole in a neighborhood and adjacent target zones such as buildings. The conversion box is capable of picking up ZigBee signals (or other signals from short range devices or inter-building local area networks of devices in or near the target zones) from the buildings adjacent the light pole. This arrangement replaces the mobile "meter reader". The conversion box, including a transceiver, forms a node in a neighborhood mesh network of like nodes. This neighborhood mesh network then transmits the information in the signals to the nearest node of the municipal WiFi network, perhaps on the same light pole. The WiFi network, in turn, communicates the signal to the municipal electricity monitoring system for billing purposes, either directly (if the water monitoring system is on the WiFi network), or possibly through a gateway to the Internet, and on to the electricity monitoring system.

It should be understood that the signal could be communicated from the neighborhood network to the municipal electricity monitoring system by any of many available communication paths and technologies.

The conversion box node could be powered by tapping electricity from the street light pole, typically by connection to the standard NEMA locking three-prong plug normally available on the top of utility light poles.

Thus, one novel element of this invention is the conversion box outside the house on the light pole, that picks up the short range signals from adjacent ZigBee transmitters (or other low-power, short-range technology or networks) in or on the adjacent houses and transmits information in those signals, through a proprietary neighborhood mesh network, then through the standard municipal WiFi network, and perhaps directly through the Internet, to the monitoring center.

The system can be used for remote monitoring of almost any activity that is going on within a building or other site. Furthermore, because all of the technologies are two-way, the system can also be used to control activities within the remote building.

The low-power end user device or devices in the target zone and their topography could take several distinct forms as a result of two variables. First of all, the lowest level, low-power transponders could be selected from a number of different technologies, of which ZigBee and RFID are specifically mentioned and preferred. Furthermore, the topology below the light pole device could take several forms. One embodiment would involve each transponder communicating directly with the light pole device. In another embodiment, the transponders could be part of a transponder local area network (LAN) within the building and the LAN includes a gateway that communicates with the light pole device. The transponder LAN could be a mesh network, or it could be a more conventional network topology such as a star network. These various choices and their permutations and combinations could result in a large number of very different topographies at the building level.

This invention takes advantage of two very significant trends. First, energy management philosophies are changing toward more efficient use of energy and other resources. Time of Use (TOU) electrical and other resource rates will soon be the mainstream and will be desirable because such rate management will encourage more efficient use of energy and other resources.

At the same time, the formation of the ZigBee Alliance in accordance with ANSI 802.15.4 and the creation of the ZigBee standard allows manufacturers to produce low-cost wireless monitor and control products based on the ZigBee standard. These wireless monitor and control products can be installed in residential, commercial, or industrial buildings, lots, or even in movable objects such as vehicles.

The relevant shortcomings of the ZigBee devices and RFID devices is that they have relatively short range and have relatively narrow bandwidth.

This invention involves taking the ZigBee standard to the next level, that is, integrating it with a wide-area mesh of interconnected communication nodes ideally located to communicate with low-cost, short range ZigBee or other 802.15.4 AMR/TOU meters or other local devices. By integrating the local ZigBee devices with the nodes on the wide-area mesh, the ZigBee devices can indirectly communicate over a wide area including communication with global computer networks such as the Internet.

This invention consists of a mesh of photoelectric roadway lighting controls, or other devices mounted high on light poles, utility poles, or other tall local structures, the controls or other devices being designed and equipped to communicate with ZigBee or other 802.15.4 wireless meters or other devices and to transfer data over wide areas and/or to the Internet.

"Gap" nodes, that link the local ZigBee devices with the wide-area network, can be mounted on poles, sides of buildings, or other elevated structures to provide enhanced line of sight communication. The devices can be powered by solar energy, battery, inductive coupling or direct wiring to the structures on which they are mounted.

"Gap" nodes, that link the network together can be mounted on poles, sides of buildings, or other elevated structures to provide enhanced line of sight communication. The devices can be powered by solar energy, battery, inductive coupling or direct wiring to the structures on which they are mounted.

This invention contemplates that the highly elevated location of the nodes on the street side poles provides a clean line of sight for optimum communication with the ZigBee or RDIF units, and with the rest of the network.

At the local site (e.g., a home), ZigBee sensors and switches are built into or on a network of appliances that can talk to each other, and, ideally, to a central site computer. The ZigBee technology is less expensive than Wi-Fi or Bluetooth, and can be used to monitor and adjust temperature, check whether a door is open, or closed, locked or unlocked, turn on or off appliances, or other monitoring or controlling functions within the building. Such functions might include security lighting control and monitoring motion, detecting garage door opening, flood detected, monitoring and control of electricity or other energy use, monitoring and control of heating fuel use, and other building functions.

The cost of the system of this invention for Time of Use energy meter reading would be offset by the benefits the system provides by other applications. Other applications include homeland security, safety/security alarm systems, home/industry automation, and street and area lighting system maintenance.

Referring first to FIG. 1 in which the general features of the monitoring and control system of the present invention are shown, the system designated generally as numeral 10, includes a first target zone 11, which might be a home, but also might be a warehouse, a business building, a parking lot, a storage yard, or a stationary or moving vehicle or any other stationary or mobile entity that merits monitoring and/or control. FIG. 1 also includes a second target zone 12, which might be another home. Target zone 11 contains an end-user device 13 that is capable of monitoring and/or controlling a certain parameter 14 (such as temperature, water level, water flow, cumulative water use, instantaneous or cumulative electric power use, intrusion within the target zone, etc.) in the target zone 11. End-user device 13 also includes a short-range radio 15, which is preferably a transceiver (transmitter and receiver), and which is preferably a ZigBee device or RFID device or a device based on a technology that allows the device to have very low power consumption and long battery life (at least 100 days, and preferably at least 1000 days). The end-user device 13 includes a radio that preferably has low power requirements (battery life of at least 100 days, and preferably at least 1000 days, is very inexpensive to produce (about $2 per unit), has short communication range (up to about 100 meters), and has narrow communication bandwidth (20-250 KB/s).

The end user devise 13 also includes a monitoring and/or control devise such as an instantaneous-use electric meter, an accumulated-use electric meter, a thermometer, a thermostat, an intrusion sensor, a water shut-off device, or other such device.

The end-user device 13 could be a single device or it could be a local network of devices, each with its own communication address.

Second target zone 12 also contains an end-user device 16 which would preferably be very similar to the end user device 13 in target zone 11, but could be different and could monitor and/or control a different parameter in target zone 12. End-user device 16 would include a short-range radio 17.

The low-power radio 15 and the low-power radio 17 would each include a different communication address.

For example, the end-user device 13 in target zone 11 might be capable of monitoring the presence or absence of significant water on the floor of the basement of target zone 11. Furthermore, the end-user device 13 might be capable of controlling the flow of water into the target zone 11.

Adjacent the first target zone 11 and the second target zone 12 is a municipal light pole 18. Mounted substantially at the top of the utility light pole 18 is a communication node 19. The communication node 19 includes a first radio 21 that is communicatively compatible with the radio 15 in target zone 11 through signal 22 and with the radio 17 in target zone 12 through signal 23. Node 19 is in close proximity to those radios 15 and 17.

The node 19 also includes a second radio 24 that is communicatively compatible with a radio 25 on a communication node 26, mounted on utility light pole 27, through signal 28.

The node 26 also includes a second radio 29 that is communicatively compatible with a radio 30 on a communication node 31, mounted on utility light pole 32, through signal 33.

One of the light poles, and more specifically light pole 32, also includes, in addition to a node 31, a second device denominated a data collector 34. Node 31 also includes a radio 35 that communicates through signal 36 with a radio 37 on data collector 34.

Each of the nodes 19, 26, and 31, and the data collector 34, contain a central processing unit 38, 39, 40, and 41, respectively. The central processing units 38, 39, 40, and 41 are programmed so that each of the nodes is capable of communicating data with end-user units adjacent to the respective pole of each node, and forming a mesh network that allows intercommunication and transmission between the nodes and other neighborhood nodes, and communication of the data with the data collector 34 as part of the neighborhood mesh network 42.

The data collector 34 includes upward data collector communication device 43 capable of communicating the data with a downward Internet communication device 44 located in an Internet connection 45 through a Internet signal 46. This Internet connection 45 would typically be a local node or "hot spot" on a municipal wide area network that provides Internet access.

The Internet connection 45 includes upward Internet connection communication device 47 capable of communicating the data with a downward server communication device 48 located in a server 49 through a server signal 50.

The server 49 includes an upward server communication device 51 capable of communicating the data with a downward end-user communication device 52 located in an end-user site 53 through an end user signal 54.

The communication nodes (for example 19, 26, and 31) and the data collector (for example 34) are connected to and draw electric power from the utility poles, using the standard NEMA locking three-pole sockets normally present on the top of the poles, and represented by electrical connectors 95, 96, 97, and 98, respectively.

In the case where the system 10 is designed to monitor basement flooding in the target zone 11 and to control the flow of water into the target zone 11, the end-user device 13 would be capable of detecting the presence of excess water in the basement floor. It would send a signal 22 to the adjacent node 19. The signal would include data and the communication address of the end-user device 13. The adjacent node 19 would send a signal 28 to node 26, that would, in turn, send a signal 33 to node 31. Node 31 known would send a signal 36 to data collecting device 34 that would in turn send a signal 46 to the Internet connection 45. The Internet connection 45 would send a signal 50 to the server 49. The server 49 would send a signal 54 to the end-user 53. The end-user 53 would determine an appropriate response to the data, and, if that response was to shut off the water coming into the target zone 11, the end-user 53 would send data in a signal 54 back to the server 49. The server 49 would then send a signal 50 back to the Internet connection 45. The Internet connection 45 would send a signal 46 to the data collector 34. The data collector 34 would send a signal 36 to the node 31. The node 31 would send a signal 33 to the node 26. Node 26 would send a signal 28 to node 19. Node 19 would send a signal 22 to the end-user device 13 which would then shut off the water coming into target zone 11.

Figure 2:
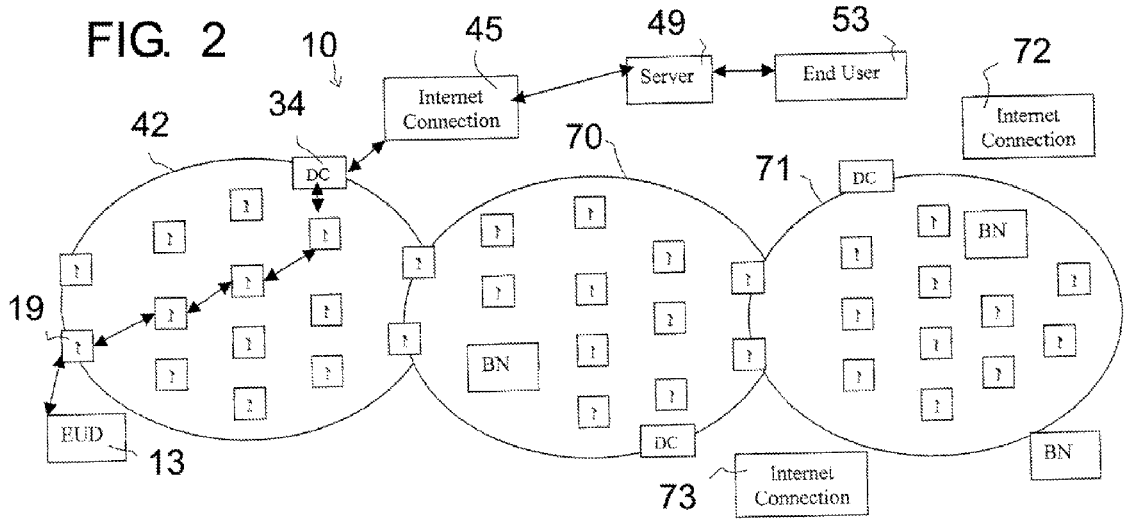
FIG. 2 is a schematic diagram of communication system for monitoring and controlling a target site by a remote end user embodying the principles of the present invention, showing interlocking neighborhood network.

Referring now to FIG. 2, the system 10 is shown installed in a geographic area incorporating three adjacent neighborhoods and in a form in which there are three interconnected neighborhood networks 42, 70, and 71, arranged in the three adjacent neighborhoods. Adjacent to neighborhoods are three Internet connections 45, 72 and 73, each of which is able to communicate with a server 49, and thereby with the end-user 53.

Data, carried by signals, the flow of which is represented by double pointed lines, would be gathered in the target zone 11 by end-user device 13 (EUD), for example, the signal would go to and from an end user device 13 or WPAN to a node 19 via the ZigBee protocol or other low-power protocol. The node 19 would translate the signal to and from the end user device or WPAN and communicate the data through the neighborhood network 40, from node to node, via a proprietary protocol, to a data collector 34 (DC). The network nodes are represented by boxes containing a single piece streetlight figure. The data collector 34 would support a neighborhood network 42 or LAN of nodes (each LAN illustrated in the circles in FIG. 2). The data collector 34 would translate the data to and from the neighborhood mesh network 42 and communicate the data to the Internet connection 45. This would be done via WiFi, telephone, cell phone, WiMax, fiber, or other means. The data from the Internet connection 45 would be accessed by a server 49 that converts the data for end user use. The data would be communicated to end user 53 via web site access, e-mail, telephone, pager, home display, or other means of communication. The node 19 could also communicate with RFID (Radio Frequency Identification) devices and communicate the data the same way as the ZigBee data.

Figure 3:
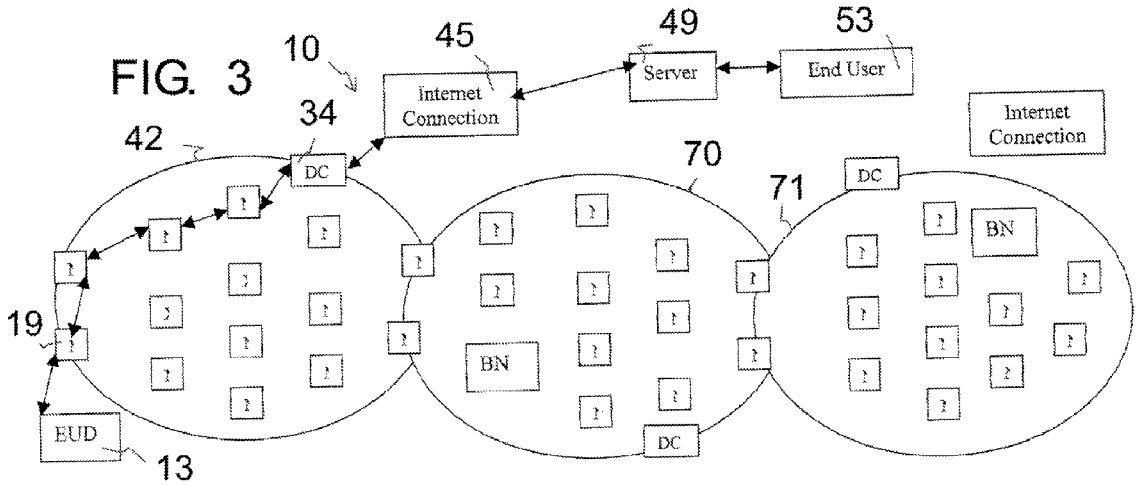
FIG. 3 is a schematic diagram of communication system for monitoring and controlling a target site by a remote end user embodying the principles of the present invention, showing self-recovery from a neighborhood network node failure.

Referring to FIG. 3, the system shown in FIG. 2 is represented again, except that some of the neighborhood network nodes through which the signal passed are not operating or are busy. These inoperative or busy nodes are represented by a two-piece figure. When these nodes are not operating or are busy, the data would be routed via a different path through the mesh by the mesh firmware.

Figure 4:
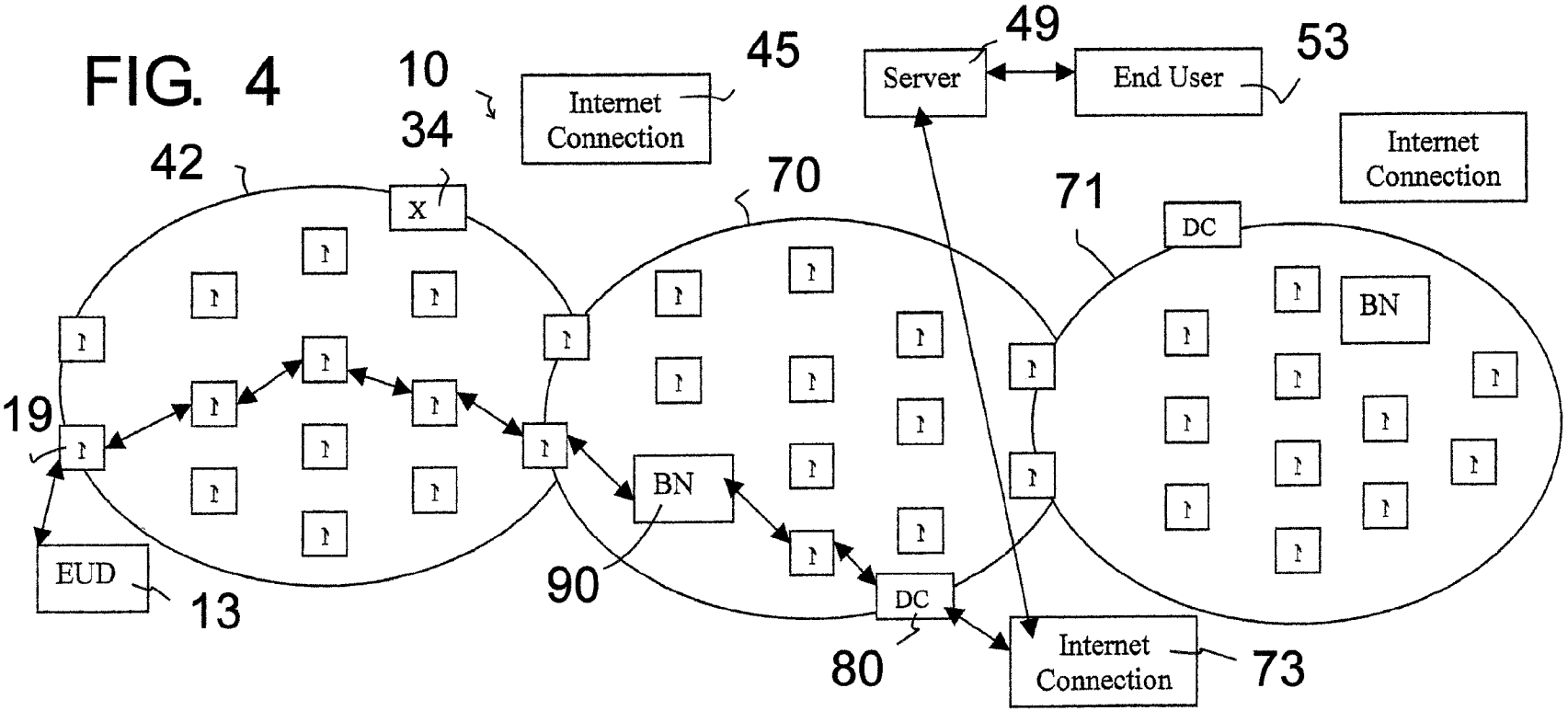
FIG. 4 is a schematic diagram of communication system for monitoring and controlling a target site by a remote end user embodying the principles of the present invention showing self-recovery from a neighborhood network data collector failure.

Referring to FIG. 4, the system shown in FIG. 2 and FIG. 3 is represented again except that the data collector 34 is not operating or is busy. This is designated by the letter X. If a data collector 34 is not operating or if it is busy, the data would be routed through another LAN. More specifically, the signal will be routed from node to node a cross the neighborhood network 42, and then will be passed into neighborhood network 70 through a Bridge node 90 (BN) which communicatively connects neighborhood network 42 with neighborhood network 70. The signal is then routed from node to node across neighborhood network 70, to the data collector 80 on neighborhood network 70. From data collector 80, the signal is routed to Internet connection 73, then to server 49, and then to the end-user 53.

Figure 5:
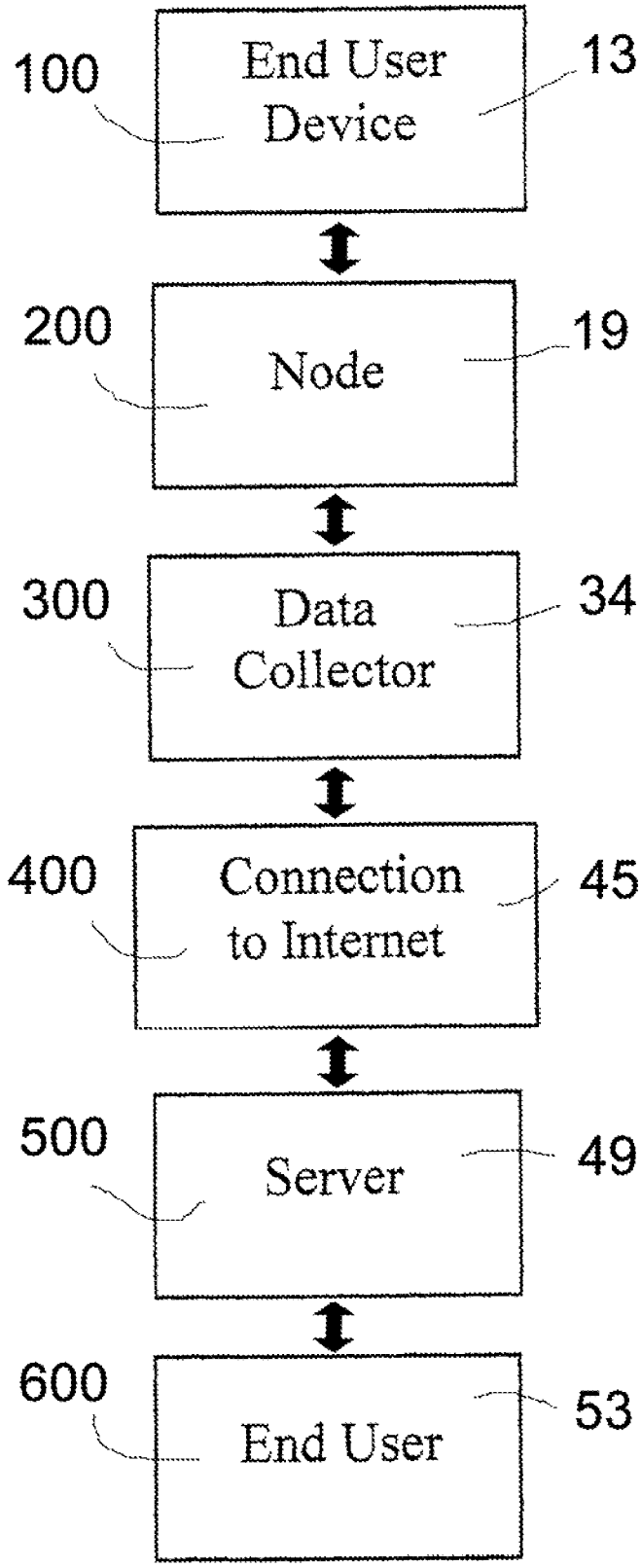
FIG. 5 is a flow chart of communication system for monitoring and controlling a target site by a remote end user embodying the principles of the present invention.

FIG. 5 shows a flow chart of the information flow from one end of the system to the other, that is, from the end-user device 13 to the end-user 53. If the system were strictly for monitoring, the signals could flow in one direction from the end user device 13 in the target zone 11, to the end user 53. In the case of monitoring and control systems, the information would flow from the end user device 13 in the target zone 11, to the remote end user 53, and then control signals would travel back from the remote end user 53 to an end user device 13.

Element 100 represents the ZigBee end user device 19 that will be given a communication address. It may include multiple addresses that are part of a WPAN (Wireless Personal Area Network). It will perform a function(s) for the end user 53's purposes. It could send and/or receive information. The end user device 19 may also be a RFID (Radio Frequency Identification) device that does not use ZigBee communications technology.

Element 200 represents the node 19 in the neighborhood network 40. The node will be located on a utility pole adjacent target zone 11 and will be powered by electricity present in the utility pole. The communication between Element 100 and Element 200 will be made via ZigBee protocol between the End User Device(s) 13 and the Node 19, or between the end-user device 13 employing RFID technology, and the node 19.

In Element 200, the node will have a communication address. Data will be translated in the node 19 between the ZigBee or RFID protocol and a proprietary protocol. Data will include encryptions that include the End User Address and Node Address.

Between Elements 200 and 300, the encrypted data will be communicated through the neighborhood node mesh network to a Data Collector 34 in the neighborhood network 42.

In Element 300, the Data Collector 34 will be given a communication address. In the Data Collector 34, the Data will be translated between the proprietary protocol to a standard protocol for Internet access.

Between Elements 300 in 400, communications will be made between the Data Collector 34 in Element 300 and an Internet Connection 45 in Element 400, using WiFi, WiMax, Fiber, Cell Phone, Telephone, or other means.

The Internet Connection in Element 400 could be a communicator or transceiver using WiFi, WiMax, Fiber, Cell Phone, Telephone, or other means. Conceptually, Element 400 would include the infrastructure of the Internet.

Data handled by the Internet in Element 400 would be communicated to and processed and stored by a Server 49 in Element 500.

The data on the Server 49 in Element 500 would be communicated to the end user 53 in Element 600. This communication could be made via web site access into the Server 49, e-mail, fiber, telephone, cellular, pager, fax, or other means. Data from the Internet may be processed by a proprietary end user server.

Various embodiments of the invention provide a communication system that provides communication of information between an end user device and a remote end user. The system includes a communication node mounted on the upper part of a utility pole. Preferably, the node draws its power from the utility pole through a standard NEMA Locking 3 Pole Receptacle, and is adapted to communicate with a nearby user device using the low-power communication protocol, such as the ZigBee protocol (ANSI IEEE 802.15.4) or Radio Frequency Identification Device (RFID) technology, and also adapted to communicate with a neighborhood mesh network of nodes mounted on utility poles. The neighborhood mesh network is capable of communicating, through a regional computer network, with the remote end user.

More specifically the invention involves a communication system that provides communication of information between an end user device and an end user, comprising the Internet, a global computer network, and a node mounted on the upper part of a utility pole, and adapted to communicate using the ZigBee protocol.

The invention also includes an end user device, comprising an actuator adapted to monitor or control a local parameter, and a communicator, that has a unique address, and is adapted to communicate information with the actuator, and adapted to communicate information with the node, using the ZigBee protocol.

The invention may also include a mesh network comprising a plurality of network nodes, at least one of which is the said node, each network node being adapted to communicate with a plurality of other network nodes on the mesh network, and a data collector/bridge that is a network node, and that is adapted to communicate the information with the mesh network and thereby with the said node, and communicate the information with the Internet.

The invention may also include a server linked to the Internet, and adapted to communicate the information with the Internet, and an end user port adapted to allow the end user to communicate the information with the server.

The invention may also include an end user adapted to communicate the information with the end user port and thereby communicate the information with the end user device.

For example, the system might monitor instantaneous electricity use rate. The communication system might provide communication of information about instantaneous electricity use rate and local time between an end user device and an end user. It might include the Internet, a global computer network, a node mounted on the upper part of a utility pole, and adapted to communicate using the ZigBee protocol, an end user device, comprising an actuator adapted to monitor or control the electric use rate, and a communicator, that has a unique address, and is adapted to communicate information with the actuator, and adapted to communicate information with the node, using the ZigBee protocol.

The system might include a mesh network comprising a plurality of network nodes, at least one of which is the said node, each network node being adapted to communicate with a plurality of other network nodes on the mesh network, a data collector/bridge that is a network node, and that is adapted to communicate the information with the mesh network and thereby with the said node, and communicate the information with the Internet.

The system might also include a server linked to the Internet, and adapted to communicate the information with the Internet, an end user port adapted to allow the end user to communicate the information with the server, and an end user adapted to communicate the information with the end user port and thereby communicate the information with the end user device or WPAN to a node via the ZigBee protocol. The nodes would translate the data to and from the end user device or WPAN and communicate the data through the network via a proprietary protocol to a data collector. The data collector would support a LAN of nodes. The data collector would translate the data to and from the mesh network and communicate the data to the Internet. This would be done via WiFi, telephone, cell phone, WiMax, or other means. The data from the Internet would be accessed by a server that converts the data for end user use. The data would be communicated to end users via web site access, e-mail, telephone, pager, or other means of communication. The nodes could also communicate with RFID (Radio Frequency Identification) devices and communicate the data the same way as the ZigBee data.

One of the ideas that could be used in various embodiments of this invention is the idea that some of the communication devises could be mounted atop and draw their power from light or other utility poles. Street and Area Lights are installed to provide illumination for safety, recreational, and other purposes. They are often fitted with a NEMA Locking 3 Pole Receptacle. This receptacle would typically accept a Twist Lock Photo control, to control individual lights or a Shorting Cap when groups of lights are controlled by a common switch/relay. Street and Area Lights are powered with line voltages from 120 V AC to 480 V AC electrical systems.

There are devices available that fit into a NEMA Locking 3 Pole Receptacle that perform communications for street light diagnostic information and other electric utility system monitoring/alarm/control information. The presently available devices use proprietary wireless platforms to transmit data through mesh networks of like devices. The transmitted data would be sent to a server for end user access. This would typically be done through telephone, fiber, WiFi, or cell phone frequency connections.

There are devices available that utilize the IEEE 802.15.4 standard for mesh network communications for applications including but not limited to electric, gas, and water meter reading, industrial control/monitoring, hospital/patient monitoring, and residential applications.

ZigBee is the industry name for a specification for a suite of high level communication protocols using small, low-power digital radios based on the IEEE 802.15.4 standard for wireless personal area networks (WPANs).

Radio-frequency identification (RFID) is an automatic identification method, relying on storing and remotely retrieving data using devices called RFID tags or transponders. An RFID tag is an object that can be attached to or incorporated into a product, animal, or person for the purpose of identification using radio waves. Chip-based RFID tags contain silicon chips and antennas. Passive tags require no internal power source, whereas active tags require a power source.

It is convenient to access power from a streetlight NEMA Locking 3 Pole Receptacle for use by communications devices. As streetlights are high in the air, the location of the streetlight is ideal for low voltage, low data rate communications. The communications devices developed to be mounted on street lights can be designed to provide communication with end user devices that can monitor and/or controls local parameters including, electric, gas, water meter reading, industrial control/monitoring, hospital/patient monitoring, WPAN (Wireless Personal Area Network), RFID (Radio Frequency Identification), and other commercial/residential applications to be communicated to the Internet.

Some embodiments of this invention include a mesh network of devices (nodes) that would install directly into a NEMA Locking 3 Pole Street or Area Light Receptacle. The street light nodes would provide two-way communications with end user devices via standard ZigBee protocol. These end user devices could monitor various local parameters, including, but not be limited to, electric, gas, water meter reading, industrial control/monitoring, hospital/patient monitoring, security monitoring/control, location determination, and commercial/residential applications.

The street light nodes could recognize end user device's address (end user devices would be assigned an address).

The street light nodes could recognize multiple end user devices' addresses (end user devices may consist of a Wireless Personal Area Network (WPAN) with multiple addresses).

The street light nodes could perform streetlight diagnostics/control and utility system monitoring, alarm, and control.

The street light nodes could include a photoelectric control for local independent operation.

The street light nodes could include a NEMA Locking 3 Pole Street or Area Light Receptacle for separate control of the streetlight.

The street light nodes could translate the data from the ZigBee protocol to be communicated through the system via a proprietary protocol.

The street light nodes could communicate the street light diagnostic and end user information to each other via a proprietary protocol using IEEE 802.15.4 criteria.

The street light nodes could transmit information via the mesh to a data collector and/or bridge.

Some embodiments of the invention could include "bridge nodes" to fill in the mesh where streetlights are not available. The bridging nodes could perform the same functions as the street light nodes, but could be mounted elsewhere than on light poles, such as on buildings or on towers.

The bridge nodes could be powered by either direct wiring, inductive coupling, or solar.

The bridge nodes could include a battery for power.

Some embodiments of the invention may include a data collector/bridge. The data collector/bridge might perform two-way communications with the nodes in the mesh network via a proprietary protocol using IEEE 802.15.4 criteria.

The data collector/bridge might be assigned an IP address.

The data collector/bridge might translate the data from the nodes to a standard platform or protocol to be sent to a server via the Internet.

The data collector/bridge might support a LAN (Local Area Network) of nodes.

The data collector/bridge might communicate with a server via the Internet. This could be completed via telephone, fiber, WiFi, cell phone, or other means.

The invention could connect to a server that would process the data for end user use. It could be maintained by the end user or be a specific server that could translate the data for end user use.

Communications with the end user from the specific server could be made via web site access, e-mail, fiber, telephone, cellular, pager, fax, or other means.

All communications would include an encryption that includes the address of the end user device, the address of the node that communicates with the end user device, and the address of the data collector that communicates the information with the Internet connection.

The nodes could also have the ability to communicate with RFID (Radio Frequency Identification) devices and communicate the data the same way as it communicates the ZigBee device data. This may include communications using IEEE P1902.1 (wireless long wavelength) criteria.

Various embodiments of the invention might include the following benefits. The physical location of the mesh nodes, on top of streetlights, provides clean line of sight to each other and close proximity/line of sight to potential end user device locations for effective communications.

Other potential benefits of some embodiments of the invention include the fact that connecting directly to NEMA Locking 3 Pole Receptacle to get continuous AC power eliminates the need for additional wiring or connections. Installation and maintenance costs are reduced.

Other potential benefits of some embodiments of the invention include the fact that using the standard ZigBee communications protocol allows end users to design inexpensive low power short range communications products that would ultimately connect to the internet with minimal cost of communications.

Other potential benefits of some embodiments of the invention include the fact that using IEEE 802.15.4 communications criteria specifies Media Access Control (MAC) layers at the 868 MHz, 915 MHz, and 2.4 GHz ISM bands, thus enabling global or regional deployment with multiple access and collision avoidance.

Other potential benefits of some embodiments of the invention include the fact that the cost of accessing short distance communications with a drive by (e.g. meter reading) would be eliminated.

Other potential benefits of some embodiments of the invention include the fact that real time meter reading would be available. Electric rates could be adjusted for peak and non-peak times.

Other potential benefits of some embodiments of the invention include the fact that end user device and node addressing would determine a location of an end user device.

Other potential benefits of some embodiments of the invention include the fact that the nodes would be low cost because they use low power, short-range communications.

Other potential benefits of some embodiments of the invention include the fact that including the photo control in the node eliminates the cost of separate photo control.

Other potential benefits of some embodiments of the invention include the fact that end user devices would be low cost because they would use low power short range and standard ZigBee communication's electronics.

Other potential benefits of some embodiments of the invention include the fact that the monthly cost to access the Internet through a WiFi mesh network would be minimal.

Other potential benefits of some embodiments of the invention include the fact that communications between RFID devices would expand an inventory control physical area to the entire area of the mesh network.

Systems that embody the present invention could include surge protection including but not limited to metal oxide varistors, fuses, and breakers. Such systems could also include weather-resistant applications-specific housing. Such systems could also include locking type brass legs. Such systems could also include antennas. Such systems could also include software that converts information to be made available for end user device use. Such systems could also include software that converts diagnostic and line condition to be made available by lighting maintenance groups. Such systems could also include end user devices that are in a lower level ZigBee mesh (WPAN).

One of the applications of some embodiments of the present invention involves the invention's use in a technique called "usage shedding". In a situation in which a community is experiencing an occasional shortage in available resources such as electric power, it is desirable to cause the resource users in the community to reduce their resource usage during the period of the shortage. The control functions of some embodiments of the present invention allow the centralized end-user to instruct the resource-using equipment within the various target zones of the community to reduce the target zone resource usage of that equipment during the period of shortage. Because the present invention allows direct control of specific equipment within specific target zones, it becomes practical to offer incentives to the target zones that are voluntarily willing to experience the most extreme resource usage reductions. Furthermore, the monitoring functions of the present invention provide a means for assuring that the resource conservation activities within a specific target zone are being accomplished.

One variation and embodiment of the present invention involves adaptation to an existing proprietary meter reading system. In that existing system, a meter reading device within the target zone is provided with a proprietary radio that sends out an radio signal incorporating the identity of the meter reading device and the meter reading, every few seconds. The radio signal extends to the street outside of the target zone. In the prior art implementation of the existing system, a vehicle drives by the target zone from time to time carrying a proprietary receiver that is able to receive and interpret the radio signal, thereby recovering the identity of the meter reading device and the meter reading.

An embodiment of the present invention avoids the need for the "drive-by" reading concept of this existing technology, while preserving the value of both the installed existing transmitter and the existing receiver of the prior technology. The local node of the present invention could be provided with a radio receiver capable of picking up the radio signals produced by the already-installed adjacent proprietary transmitter radios of the existing system.

The existing radio transmission containing the data would be received by the local node and converted into a signal that can be transmitted on the network of the present invention to the end user. The end user would convert the transmittable signal back to a radio transmission that could then be received and interpreted by the proprietary radio receiver of the existing technology and which would otherwise be carried in the "drive-by" vehicle. In this way, the proprietary "drive-by" meter readers of the existing technology could be read remotely without actually having to conduct the "drive-by" function.

In this way, the present invention could receive the existing transmission from the existing proprietary target zone hardware, and communicate the signal to the end-user for translation of the signal by an existing proprietary receiving device, and the current invention would not need to read or decrypt the signal. Thus, the communication network of the present invention would simply provide an improvement by elimination of the need for a "drive-by" vehicle.

This embodiment of the present invention could include three concepts. The signal could be sent to the end user immediately upon receipt by the local node and the end user could read the signal immediately. In another version, the most recently broadcast version of the decoded signal could be stored at the local node and then transmitted to the end user upon request by the end-user. Thus the end-user could control the reading schedule and the data would only be transmitted to the end-user when the end-user wanted to receive it. This could be used to minimize the amount of data transmitted on the network, because the data would only be transmitted to the end user on demand. In another version, each new signal could be sent to the end user immediately by the local node, but then a series of signals or only the latest signal could be stored with the end-user until the end-user is ready to process that signal or signals. This could provide the end-user with more choice and control over the frequency of data points.

DANGER MONITORING: In one embodiment of the invention, at least some of the end-user devices are capable of monitoring chemical, biological, or radiological conditions within the target zone, and capable of communicating that monitoring information to the neighborhood network nodes, and thus to the end-user. This could be specifically designed to provide warning of unhealthful or lethal conditions within the target zone caused by accidental or intentional events or terrorist activity. In a situation where the end-user would receive wide area information about dangerous conditions within individual targets zones, the geographic extent of the dangerous condition could be monitored instantaneously and the geographic progress of the dangerous condition could be monitored over time. Such real-time geographic monitoring of dangerous conditions could provide extremely valuable information to emergency response teams, evacuation planners, and civil defense teams.

Once apprised of dangerous conditions in target zones, the end-user could also activate the end-user devices within specific target zones to provide targets zone specific instructions and warnings to the occupants of the specific target zones, such as "take cover" instructions or evacuation route instructions. The end-user could also activate the end-user devices within specific target zones to provide targets zone specific control of resources within specific target zones, such as decontamination equipment, detoxification equipment, or air exhaust or circulation systems.

DUAL FUNCTION (photo control and radio) NODES: In one embodiment of the invention, a single device is plugged into the top of and receives electric power from the light pole, and provides both a photo control function (light on dusk to dawn) for the light pole and the radio transceiver functions of a neighborhood network node.

In one version of this embodiment, both the photo control function and the radio function can be programmed onto a single microprocessor chip, thus, significantly reducing the cost of providing these two functions, because a single product package and a single microprocessor chip substitute for two separate products.

This extreme economics, however, does have one drawback. Occasionally, a microprocessor will "freeze", that is, stop functioning at a single state. This generally causes malfunction of the devices controlled by the chip or locks those devices in a single condition that existed at the time of the freeze. In the case where the single chip is providing both photo control and radio functionality, both of these functions may cease to function or cease to function properly.

Although the loss of either or both of these functions can have serious consequences, at the present time, the industry is primarily concerned with losing the photo control function. This is because the streetlight provider is often contractually obligated to repair any malfunctioning streetlights immediately, and, of course, if the streetlight is locked on during the day, electricity is wasted.

Thus, in another version of the dual-function embodiment, the device would include a third or "watchdog" function, that would sense when the microprocessor or microprocessors are not functioning properly, and would cause the malfunctioning microprocessor or microprocessors to reboot (restart), by turning the microprocessors power source off and on again or actuating a reboot function. This process very frequently causes a microprocessor to return to its normal functionality. Sometimes it does not and the device stays frozen or otherwise nonfunctional.

For example, the microprocessor may be set up to send a stream of pulses to the watchdog function. When the microprocessor locks up, the pulsing of the signal to the watchdog function would stop and the signal would be locked in either the high or the low condition. The watchdog function would sense the lack of pulsing and would cause the microprocessor to reset, either by turning off and on power to the chip or triggering a reset function, thus normally causing the microprocessor to reconfigure itself to normal operation.

In some cases, it would be preferable that the watchdog function would be included in a chip separate from the chip that is being monitored.

This factor can be implemented in a number of variations. In one case, a single chip provides both in the photo control and radio functions and a separate chip monitors that dual function chip.

In another version, the photo control chip is monitored by the watchdog function on the radio chip and the radio chip is monitored by the watchdog function on the photo control chip.

In another version, there are two dual function chips, each one monitored by a watchdog function on the other chip. In this configuration, the device could be programmed so that one dual function chip provides both functions and if it freezes, it is reset by the watchdog function on the other chip. If that does not revive the first dual function chip, then the other dual function chip automatically takes over both functions. Conversely, the device could be programmed so that normally one dual function chip handles the photo control function and the other dual function chip handles the radio function. Each chip is monitored by the watchdog function on the other chip. Then if one chip fails to on reset, the other chip takes over both functions.

In the special case where maintaining photo control functionality is the mission-critical aspect, one chip could be dual function and the other chip could be set up with photo control and the watchdog function of the other chip. The device could be programmed so that if the dual function chip failed, the photo control function of the second chip would automatically take over thus maintaining the operation of the streetlight.

It should be understood that, in all cases, the dual function device could be designed so that the radio would communicate default status of the device to the end-user, including reset requirements, backup implementations, and partial or total failures, so that the streetlight maintenance crews can immediately address any non-functionality, especially of the streetlight, and provide maintenance to restore redundancy in the case of partial failures or backup activation. One way that the radio could communicate this information is by a failsafe mode. The radio would periodically send out an addressed functionality signal that would be monitored. If the radio malfunctioned, the functionality signal would stop and the end-user would know that something was wrong with the unit.

Another very important use for the technology of the present invention involves the remote turning on and/or off of the supply of electric power to a target zone. There are many situations in which it is necessary and/or desirable to cut of electric power to a target zone and also turn on electric power that has been cut off. Such situations might involve safety issues such as fires or flammable leaks at the target zone. In such cases, it is sometimes desirable to cut off electric power during the safety problem, but then it is important to restore the electricity promptly once the safe condition is achieved so that collateral damage due to lack of electric power is minimized.

In another situation, one of the only practical ways that an electric power supply company can manage delinquent accounts is to cut off the electric supply to non-paying customer's target zone until the account is paid. In some cases, the customers tend to not pay their bills repeatedly. To encourage payment of delinquent accounts, the traditional approach is for the electric power company to send a truck to physically disconnect power, and then send another truck to reconnect power when the customer pays their unpaid bill. Both of these on-site service calls are expensive to conduct and usually require expensive "on-call" capability, so that delays in conducting service do not create additional problems, such as frozen water pipes due to lack of electric heat. Furthermore, it is often not possible to pass on the high cost of these service calls directly to the involved consumer, due to regulatory, public relation, and administrative issues.

To address this problem, especially for repeat non-payers, the end user device of the present invention could include a tamper-proof switch at or near the target zone. The switch would be capable of cutting-off and restoring the electric power to the target zone. The switch could be controlled by the inexpensive end user device radio of the present invention and the communication system of the present invention, to allow the remote end user to cut-off and reestablish power remotely, instantaneously, and without a site visit.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desire to secure by Letters Patent is:

1. A communication system that provides communication of information related to a local parameter within a target zone, between an end user device located in the target zone and an end user, comprising:

a. the end user device within the target zone, comprising an actuator adapted to interact with the local parameter within the target zone, and a low-power-consumption communicator that has a unique communication address and is adapted to communicate with the actuator and adapted to communicate outside of the target zone using a wireless protocol, wherein the low-power-consumption communicator of the end user device employs a ZigBee protocol to communicate outside of the target zone, b. a communication node mounted on an upper part of a street light pole adjacent the target zone and drawing electric power from the street light pole, and adapted to communicate with the low-power consumption communicator of the end user device using the wireless protocol, and adapted to communicate with the end user, the communication node including a watchdog function that monitors an operation of the communication node and resets the communication node if the communication node malfunctions, and the communication node providing photo control to a street light coupled to the street light pole to turn the street light on during darkness, and c. the end user adapted to communicate the information with the communication node and thereby communicate the information with the end user device.

2. The system as recited in claim 1, wherein the low-power-consumption communicator of the end user device employs Radio Frequency Identification Device (RFID) technology to communicate outside of the target zone.

3. The system as recited in claim 1, wherein the end user device is battery powered and has a battery charge life of at least 100 days.

4. The system as recited in claim 1, wherein the local parameter is an instantaneous or cumulative target zone use of a particular utility.

5. The system as recited in claim 1, wherein the local parameter is an instantaneous or cumulative target zone water use.

6. The system as recited in claim 1, wherein the local parameter is an instantaneous or cumulative target zone electricity use.

7. The system as recited in claim 1, wherein the local parameter is an instantaneous or cumulative target zone air conditioning, water heating, or pool/fountain pumps use.

8. The system as recited in claim 1, wherein the local parameter is an instantaneous or cumulative target zone heating gas use.

9. The system as recited in claim 1, wherein the local parameter is a target zone condition with respect to a presence in the target zone of chemical, biological or radiological factors or danger.

10. The system as recited in claim 1, wherein the local parameter is a target zone condition with respect to a presence in the target zone of chemical, biological or radiological factors or danger, and wherein the information communicated to the end user about the parameter indicating the target zone condition with respect to the presence in the target zone of chemical, biological or radiological factors or danger, is combined with like information about other target zones within a geographic area to provide to the end user with information about an extent and/or progress of the target zone condition within the geographic area.

11. The system as recited in claim 1, wherein the communication node includes two separate microprocessors, a first microprocessor that provides at least one of the photo control and radio functions of the communication node, and a second microprocessor that provides the watchdog function over the first microprocessor.

12. The system as recited in claim 11, wherein the first microprocessor further provides the watchdog function over the second microprocessor.

13. The system as recited in claim 11, wherein if the watchdog function senses that the first microprocessor malfunctions, the watchdog function transfers the photo control function to the second microprocessor, thus restoring the photo control function to the communication node.

14. The system as recited in claim 11, wherein the first microprocessor further provides a radio function that is monitored by the watchdog function.

15. The system as recited in claim 1, the communication node produces a function signal that changes if the communication node malfunctions, and the watchdog function monitors that function signal and senses when the communication node malfunctions.

16. The system as recited in claim 1, wherein the communication node produces a function signal that pulses when the communication node is functioning properly and stops pulsing when the communication node malfunctions, and the watchdog function monitors that function signal and senses when the communication node malfunctions.

17. The system as recited in claim 1, wherein the communication node draws electric power from the pole through a NEMA locking three-prong receptacle on the top of the street light pole.

18. The system as recited in claim 1, wherein the communication node draws electric power from the street light pole by being connected to the street light pole by a NEMA locking three-prong receptacle on the top of the street light pole.

19. A communication system that provides communication of information related to a local parameter within a target zone, between an end user device located in the target zone and an end user, comprising:

a. the end user device within the target zone, comprising an actuator adapted to interact with the local parameter within the target zone and a low-power-consumption communicator that has a unique communication address and is adapted to communicate with the actuator and adapted to communicate outside of the target zone using a wireless protocol, wherein the low-power-consumption communicator of the end user device employs a ZigBee protocol to communicate outside of the target zone, b. a communication node mounted on an upper part of a street light pole adjacent the target zone and drawing electric power from the street light pole, and adapted to communicate with low-power-consumption communicator of the end user device using the wireless protocol, the communication node including a watchdog function that monitors an operation of the communication node and resets the communication node if the communication node malfunctions, and the communication node providing photo control to a street light coupled to the street light pole to turn the street light on during darkness, c. a neighborhood mesh network comprising a plurality of network nodes, at least one of which is the communication node, each network node being adapted to communicate with a plurality of other network nodes on the neighborhood mesh network and located with a geographic neighborhood, d. a data collector that is one of the plurality of network nodes, and that is adapted to communicate the information with the neighborhood mesh network and thereby with the communication node, and to communicate the information with the end user, and e. the end user adapted to communicate the information with the end user device.

20. The system as recited in claim 19, wherein the low-power-consumption communicator of the end user device employs Radio Frequency Identification Device (RFID) technology to communicate outside of the target zone.

21. The system as recited in claim 19, wherein the end user device is battery powered and has a battery charge life of at least 100 days.

22. The system as recited in claim 19, wherein the local parameter is an instantaneous or cumulative target zone use of a particular utility.

23. The system as recited in claim 19, wherein the local parameter is an instantaneous or cumulative target zone water use.

24. The system as recited in claim 19, wherein the local parameter is an instantaneous or cumulative target zone electricity use.

25. The system as recited in claim 19, wherein the local parameter is an instantaneous or cumulative target zone air conditioning, water heating, or pool/fountain pumps use.

26. The system as recited in claim 19, wherein the local parameter is an instantaneous or cumulative target zone heating gas use.

27. The system as recited in claim 19, wherein the local parameter is a target zone condition with respect to a presence in the target zone of chemical, biological or radiological factors or danger.

28. The system as recited in claim 19, wherein the local parameter is a target zone condition with respect to a presence in the target zone of chemical, biological or radiological factors or danger, and wherein the information communicated to the end user about the parameter indicating the target zone condition with respect to the presence in the target zone of chemical, biological or radiological factors or danger, is combined with like information about other target zones within a geographic area to provide to the end user with information about an extent and/or progress of the target zone condition within the geographic area.

29. The system as recited in claim 19, wherein the communication node includes two separate microprocessors, a first microprocessor that provides at least one of the photo control and radio functions of the communication node, and a second microprocessor that provides the watchdog function over the first microprocessor.

30. The system as recited in claim 29, wherein the first microprocessor further provides the watchdog function over the second microprocessor.

31. The system as recited in claim 29, wherein if the watchdog function senses that the first microprocessor malfunctions, the watchdog function transfers the photo control function to the second microprocessor, thus restoring the photo control function to the communication node.

32. The system as recited in claim 29, wherein the first microprocessor further provides a radio function that is monitored by the watchdog function.

33. The system as recited in claim 19, the communication node produces a function signal that changes if the communication node malfunctions, and the watchdog function monitors that function signal and senses when the communication node malfunctions.

34. The system as recited in claim 19, wherein the communication node produces a function signal that pulses when the communication node is functioning properly and stops pulsing when the communication node malfunctions, and the watchdog function monitors that function signal and senses when the communication node malfunctions.

35. The system as recited in claim 19, wherein the communication node draws electric power from the pole through a NEMA locking three-prong receptacle on the top of the street light pole.

36. The system as recited in claim 19, wherein the communication node draws electric power from the street light pole by being connected to the street light pole by a NEMA locking three-prong receptacle on the top of the street light pole.

37. The system as recited in claim 19, wherein the data collector translates the information for communication between the neighborhood mesh network and another network that uses at least one of WiFi, telephone, cell phone, fiber, or WiMax.

38. The system as recited in claim 19, further comprising a server that converts the information for end user access through the Internet.

39. The system as recited in claim 19, wherein the information is communicated to a plurality of end users via web site access, in home display, e-mail, telephone, or pager.

40. A communication system that provides communication of information related to a local parameter within a target zone, between an end user device located in the target zone and an end user, comprising:

a. the end user device within the target zone, comprising an actuator adapted to interact with the local parameter within the target zone, and a low-power-consumption communicator that has a unique communication address and is adapted to communicate information with the actuator, and adapted to communicate information outside of the target zone using a wireless protocol, wherein the low-power-consumption communicator of the end user device employs a ZigBee protocol to communicate outside of the target zone, b. a communication node mounted on an upper part of a street light pole adjacent the target zone and drawing electric power from the street light pole, and adapted to communicate with the end user device communicator using the wireless protocol, the communication node including a watchdog function that monitors an operation of the communication node and resets the communication node if the communication node malfunctions, and the communication node providing photo control to a street light coupled to the street light pole to turn the street light on during darkness, c. a neighborhood mesh network comprising a plurality of network nodes, at least one of which is the communication node, each network node being adapted to communicate with a plurality of other network nodes on the neighborhood mesh network and located with a geographic neighborhood, d. a data collector that is one of the plurality of network nodes, and that is adapted to communicate the information with the neighborhood mesh network and thereby with the communication node, and to communicate the information with the end user, e. another neighborhood mesh network adapted to provide an alternative path between the end user device and the end user whenever the neighborhood mesh network fails to provide a path between the end user device and the end user, and f. the end user adapted to communicate the information with the end user device.

41. The system as recited in claim 40, wherein the low-power-consumption communicator of the end user device employs Radio Frequency Identification Device (RFID) technology to communicate outside of the target zone.

42. The system as recited in claim 40, wherein the end user device is battery powered and has a battery charge life of at least 100 days.

43. The system as recited in claim 40, wherein the local parameter is an instantaneous or cumulative target zone use of a particular utility.

44. The system as recited in claim 40, wherein the local parameter is an instantaneous or cumulative target zone water use.

45. The system as recited in claim 40, wherein the local parameter is an instantaneous or cumulative target zone electricity use.

46. The system as recited in claim 40, wherein the local parameter is an instantaneous or cumulative target zone air conditioning, water heating, or pool/fountain pumps use.

47. The system as recited in claim 40, wherein the local parameter is an instantaneous or cumulative target zone heating gas use.

48. The system as recited in claim 40, wherein the local parameter is a target zone condition with respect to a presence in the target zone of chemical, biological or radiological factors or danger.

49. The system as recited in claim 40, wherein the local parameter is a target zone condition with respect to a presence in the target zone of chemical, biological or radiological factors or danger, and wherein the information communicated to the end user about the parameter indicating the target zone condition with respect to the presence in the target zone of chemical, biological or radiological factors or danger, is combined with like information about other target zones within a geographic area to provide to the end user with information about an extent and/or progress of the target zone condition within the geographic area.

50. The system as recited in claim 40, wherein the communication node includes two separate microprocessors, a first microprocessor that provides at least one of the photo control and radio functions of the communication node, and a second microprocessor that provides the watchdog function over the first microprocessor.

51. The system as recited in claim 50, wherein the first microprocessor further provides the watchdog function over the second microprocessor.

52. The system as recited in claim 50, wherein if the watchdog function senses that the first microprocessor malfunctions, the watchdog function transfers the photo control function to the second microprocessor, thus restoring the photo control function to the communication node.

53. The system as recited in claim 50, wherein the first microprocessor further provides a radio function that is monitored by the watchdog function.

54. The system as recited in claim 40, the communication node produces a function signal that changes if the communication node malfunctions, and the watchdog function monitors that function signal and senses when the communication node malfunctions.

55. The system as recited in claim 40, wherein the communication node produces a function signal that pulses when the communication node is functioning properly and stops pulsing when the communication node malfunctions, and the watchdog function monitors that function signal and senses when the communication node malfunctions.

56. The system as recited in claim 40, wherein the communication node draws electric power from the pole through a NEMA locking three-prong receptacle on the top of the street light pole.

57. The system as recited in claim 40, wherein the communication node draws electric power from the street light pole by being connected to the street light pole by a NEMA locking three-prong receptacle on the top of the street light pole.

58. The system as recited in claim 40, wherein the data collector translates the information for communication between the neighborhood mesh network and another network that uses at least one of WiFi, telephone, cell phone, fiber, or WiMax.

59. The system as recited in claim 40, further comprising a server that converts the information for end user access through the Internet.

60. The system as recited in claim 40, wherein the information is communicated to a plurality of end users via web site access, in home display, e-mail, telephone, or pager.

61. A communication system that provides communication of information related to a local parameter within a target zone, between an end user device located in the target zone and an end user, comprising:

a. the end user device within the target zone, comprising an actuator adapted to interact with the local parameter within the target zone, and a low-power-consumption communicator, that has a unique communication address, and is adapted to communicate with the actuator, and adapted to communicate outside of the target zone using a wireless protocol, wherein the low-power-consumption communicator of the end user device employs a ZigBee protocol to communicate outside of the target zone, b. a communication node mounted on an upper part of a street light pole adjacent the target zone and drawing electric power from the street light pole, and adapted to communicate with the end user device communicator using the wireless protocol, the communication node including a watchdog function that monitors an operation of the communication node and resets the communication node if the communication node malfunctions, and the communication node providing photo control to a street light coupled to the street light pole to turn the street light on during darkness, c. a neighborhood mesh network comprising a plurality of network nodes, at least one of which is the communication node, each one of the network nodes being adapted to communicate with a plurality of other ones of the network nodes on the neighborhood mesh network, d. a data collector that is one of the plurality of network nodes, and that is adapted to communicate the information with the mesh network and thereby with the said node, and communicate the information with a global computer network, e. a server linked to the global computer network, and adapted to communicate the information with the global computer network, and with an end user port, f. the end user port adapted to allow the end user to communicate the information with the server, and g. the end user adapted to communicate the information with the end user port and thereby communicate the information with the end user device.

62. The system as recited in claim 61, wherein the low-power-consumption communicator of the end user device employs Radio Frequency Identification Device (RFID) technology to communicate outside of the target zone.

63. The system as recited in claim 61, wherein the end user device is battery powered and has a battery charge life of at least 100 days.

64. The system as recited in claim 61, wherein the local parameter is an instantaneous or cumulative target zone use of a particular utility.

65. The system as recited in claim 61, wherein the local parameter is an instantaneous or cumulative target zone water use.

66. The system as recited in claim 61, wherein the local parameter is an instantaneous or cumulative target zone electricity use.

67. The system as recited in claim 61, wherein the local parameter is an instantaneous or cumulative target zone air conditioning, water heating, or pool/fountain pumps use.

68. The system as recited in claim 61, wherein the local parameter is an instantaneous or cumulative target zone heating gas use.

69. The system as recited in claim 61, wherein the local parameter is a target zone condition with respect to a presence in the target zone of chemical, biological or radiological factors or danger.

70. The system as recited in claim 61, wherein the local parameter is a target zone condition with respect to a presence in the target zone of chemical, biological or radiological factors or danger, and wherein the information communicated to the end user about the parameter indicating the target zone condition with respect to the presence in the target zone of chemical, biological or radiological factors or danger, is combined with like information about other target zones within a geographic area to provide to the end user with information about an extent and/or progress of the target zone condition within the geographic area.

71. The system as recited in claim 61, wherein the communication node includes two separate microprocessors, a first microprocessor that provides at least one of the photo control and radio functions of the communication node, and a second microprocessor that provides the watchdog function over the first microprocessor.

72. The system as recited in claim 71, wherein the first microprocessor further provides the watchdog function over the second microprocessor.

73. The system as recited in claim 71, wherein if the watchdog function senses that the first microprocessor malfunctions, the watchdog function transfers the photo control function to the second microprocessor, thus restoring the photo control function to the communication node.

74. The system as recited in claim 71, wherein the first microprocessor further provides a radio function that is monitored by the watchdog function.

75. The system as recited in claim 61, the communication node produces a function signal that changes if the communication node malfunctions, and the watchdog function monitors that function signal and senses when the communication node malfunctions.

76. The system as recited in claim 61, wherein the communication node produces a function signal that pulses when the communication node is functioning properly and stops pulsing when the communication node malfunctions, and the watchdog function monitors that function signal and senses when the communication node malfunctions.

77. The system as recited in claim 61, wherein the communication node draws electric power from the pole through a NEMA locking three-prong receptacle on the top of the street light pole.

78. The system as recited in claim 61, wherein the communication node draws electric power from the street light pole by being connected to the street light pole by a NEMA locking three-prong receptacle on the top of the street light pole.

79. The system as recited in claim 61, wherein the data collector translates the information for communication between the neighborhood mesh network and another network that uses at least one of WiFi, telephone, cell phone, fiber, or WiMax.

80. The system as recited in claim 61, further comprising a server that converts the information for end user access through the global network.

81. The system as recited in claim 61, wherein the information is communicated to a plurality of end users via web site access, in home display, e-mail, telephone, or pager.

* * * * *